US006178775B1

(12) United States Patent
Higginbotham et al.

(10) Patent No.: US 6,178,775 B1
(45) Date of Patent: Jan. 30, 2001

(54) METHOD AND APPARATUS FOR SEPARATING AIR TO PRODUCE AN OXYGEN PRODUCT

(75) Inventors: Paul Higginbotham, Guildford (GB); Joseph P. Naumovitz, Lebanon, NJ (US)

(73) Assignee: The BOC Group, Inc., New Providence, NJ (US)

( * ) Notice: Under 35 U.S.C. 154(b), the term of this patent shall be extended for 0 days.

(21) Appl. No.: 09/182,981

(22) Filed: Oct. 30, 1998

(51) Int. Cl.[7] ..... F25J 3/00
(52) U.S. Cl. ..... 62/646; 62/653
(58) Field of Search ..... 62/643, 646, 648, 62/653

(56) References Cited

U.S. PATENT DOCUMENTS 5,341,646 8/1994 Langston et al. .
5,379,598 * 1/1995 Mostello ..... 62/646
5,379,599 * 1/1995 Mostello ..... 62/646
5,586,451 12/1996 Koeberle et al. .
5,845,517 * 12/1998 Attlfellner ..... 62/644

* cited by examiner

*Primary Examiner*—William Doerrler
(74) *Attorney, Agent, or Firm*—Salvatore P. Pace

(57) ABSTRACT

A method and apparatus of separating air to produce an oxygen product. In accordance with the method and apparatus the air is rectified within a double column arrangement. The lower pressure column has lower and intermediate reboilers. Nitrogen from the higher pressure column is compressed and sent to the lower reboiler and oxygen tower overhead from the higher pressure column is fed to the intermediate reboiler. The resultant liquid is used to reflux both columns. The advantages in the arrangement set forth above is that the higher pressure column may be made to operate at a lower pressure to conserve energy.

7 Claims, 1 Drawing Sheet

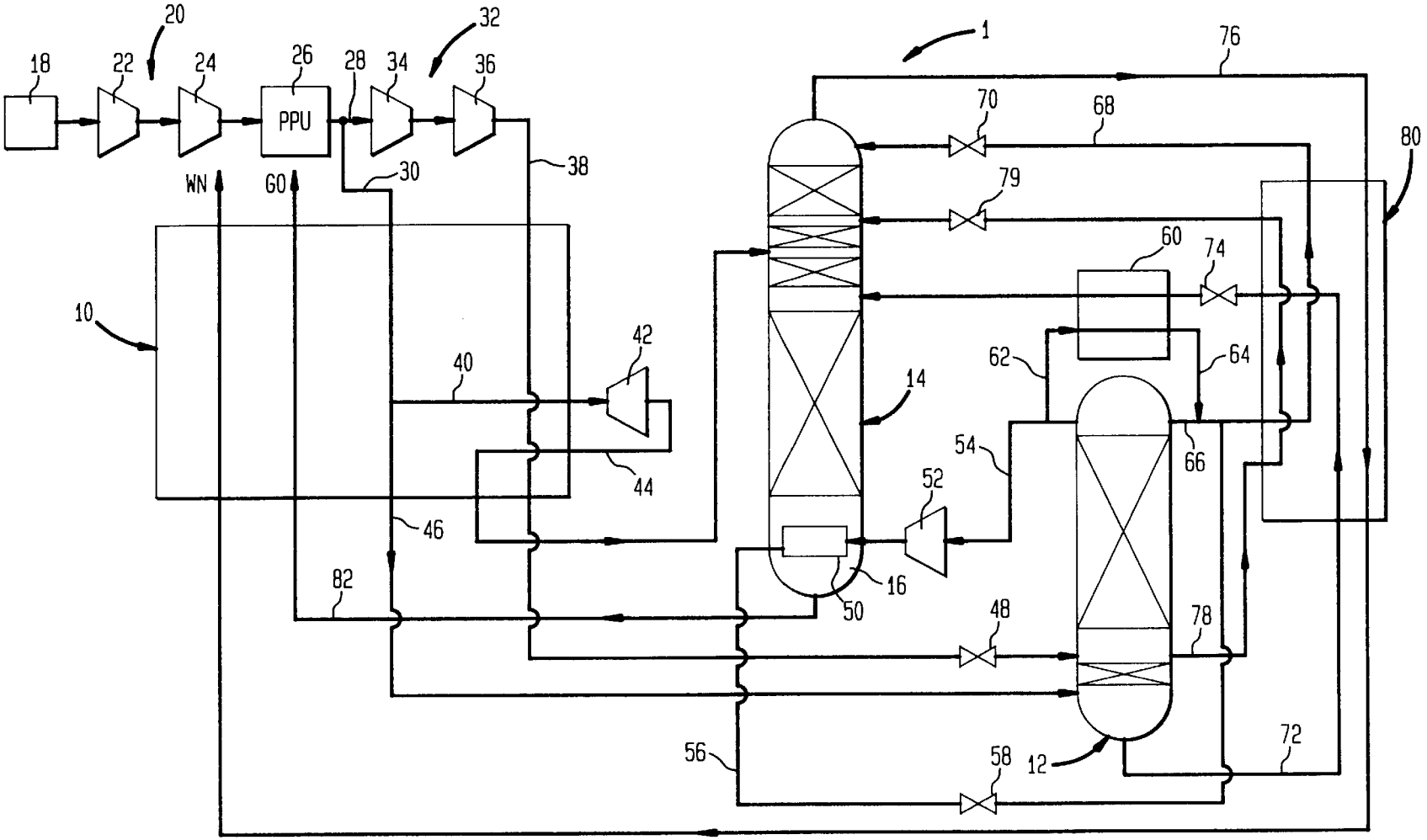
FIG.

METHOD AND APPARATUS FOR SEPARATING AIR TO PRODUCE AN OXYGEN PRODUCT

BACKGROUND OF THE INVENTION

The present invention relates to a method and apparatus for separating air to produce an oxygen product. More particularly, the present invention relates to such a method and apparatus in which air is separated in double column arrangement having higher and lower pressure columns. Even more particularly, the present invention relates to such a method and apparatus in which the lower pressure column is reboiled with compressed nitrogen vapor from the higher pressure column and the vapor rate is increased at an intermediate location thereof by generation of vaporized liquid.

Air is commonly separated in a double column arrangement having higher and lower pressure columns. Prior to separation, air is filtered and compressed. After removing the heat of compression, the air is purified by removing impurities such as carbon dioxide, moisture and heavy hydrocarbons. The resultant compressed and purified air stream is then cooled in a main heat exchanger to a temperature suitable for its rectification and introduced into double column arrangement. Liquid oxygen is produced as a column bottoms of the lower pressure column. An oxygen product is extracted as a liquid stream that may be pumped to pressurize the liquid. The liquid is then vaporized in the main heat exchanger against cooling the incoming air.

In order to reboil the lower pressure column, a condenser reboiler can be provided to condense incoming air against boiling the liquid oxygen. The air may be partially or fully condensed and is introduced into the higher pressure column. Examples of this can be found in U.S. Pat. No. 5,626,036 and WO 885893. In both of these patents the air is partially condensed to reboil the lower pressure column. Such partial condensation is advantageous in that the majority of the air may be compressed in the main compressor to a pressure below 4 bar absolute. This minimum compression will produce a minimum amount of boiling in the lower pressure column so that a liquid product may be withdrawn. Additionally, in both of these patents, an increase in the vapor rate is effected at an intermediate location of the lower pressure column by means of an intermediate reboiler in which nitrogen vapor constitutes the coolant. The condensate of such intermediate reboiler is returned to both the higher and lower pressure columns as reflux.

As will be discussed, the present invention produces greater efficiency than such prior art patents.

SUMMARY OF THE INVENTION

The present invention provides air separation method separating air to produce an oxygen product. In accordance with the method, compressed and purified air is cooled to a temperature suitable for its rectification. The cooled and compressed air is then introduced into a double rectification column system having a higher pressure column and a lower pressure column. The compressed and purified air is then rectified in the double rectification system so that a nitrogen-rich tower overhead and an oxygen-rich liquid column bottoms are produced within the higher pressure column. An oxygen liquid column bottoms is produced within the lower pressure column. The lower pressure column is reboiled by cold compressing a first nitrogen stream composed of the nitrogen-rich tower overhead and introducing the first nitrogen stream into a reboiler associated with a bottom region of the lower pressure column, thereby to form a nitrogen liquid stream. The lower pressure column is reboiled at an intermediate location thereof with a second nitrogen rich stream composed of the nitrogen-rich tower overhead, thereby to form an additional nitrogen liquid stream. The lower and higher pressure columns are refluxed with liquid nitrogen contained within the nitrogen liquid stream and the additional nitrogen rich liquid stream. A product stream composed of the oxygen liquid column bottoms is extracted from the lower pressure column and is fully warmed through indirect heat exchange with the compressed and purified air, thereby to form the oxygen product.

In another aspect, the present invention provides an apparatus for separating air to produce an oxygen product. In accordance with this aspect of the present invention, a main heat exchanger is provided for cooling compressed and purified air to temperature suitable for its rectification. A double rectification column system is also provided. The double rectification system has a higher and lower pressure column configured to rectify the air to produce a nitrogen-rich tower overhead and an oxygen-rich liquid column bottoms. An oxygen liquid column bottoms is produced within a lower pressure column. The main heat exchanger is connected to the double rectification column system so that the compressed and purified air is introduced therein. A lower reboiler is located within a bottom region of the lower pressure column. A cold compressor is interposed between the lower reboiler and the higher pressure column to compress a first nitrogen stream composed of the nitrogen-rich tower overhead and to introduce the first nitrogen stream into the lower reboiler to form a nitrogen liquid stream. An intermediate reboiler is associated with an intermediate region of the lower pressure column and connected to the higher pressure column so that a rich liquid stream, composed of the oxygen-rich column bottoms, indirectly exchangers heat with a second nitrogen rich stream composed of the nitrogen rich tower overhead, thereby to form an additional nitrogen liquid steam and a partially vaporized rich liquid stream. The lower and intermediate reboilers and the higher and lower pressure columns are all associated with one another so that the liquid nitrogen contained within the nitrogen liquid stream and the additional nitrogen liquid stream reflux the higher and lower pressure columns and the vaporized rich liquid stream is introduced into an intermediate location of the lower pressure column. The lower pressure column is connected to the main heat exchanger so that product stream composed of the oxygen liquid column bottoms as fully warmed through a direct heat exchange with the cooled and compressed air, thereby to form the oxygen product.

In a conventional double column arrangement, in which nitrogen is used to reboil the lower pressure column, the lower pressure column pressure and the higher pressure column pressure are tied to one another because the nitrogen must be at a sufficient pressure to vaporize oxygen against its own condensation, In the present invention, since cold compression is provided, that is, compression at the rectification temperature of the air, the higher pressure column may be made to operate at a lower pressure than otherwise would be required. Therefore, the main air compressor may be made to operate at a lower pressure and thus utilize less energy. At the same time, since vaporized rich liquid is being introduced into an intermediate location of the lower pressure column, boil up is increased within the lower pressure column to approximate a more ideal case. It has been calculated by the inventors therein that the present invention allows overall power requirements of an air reboiled plant to be reduced by about 2.5%.

BRIEF DESCRIPTION OF THE DRAWINGS

While the specification concludes with claims distinctly pointing out the subject mater that Applicants regard as their invention, it is believed that the invention will be better understood when taken in connection with the accompanying sole FIGURE which is a schematic representation of an apparatus used in carrying out a method in accordance with the present invention.

DETAILED DESCRIPTION

With reference to the FIG., an apparatus 1 in accordance with the present invention is illustrated. Air after having been cooled in main heat exchanger 10 to a temperature suitable for its rectification is rectified within a double column rectification system having a higher pressure column 12 and a lower pressure column 14. Although not illustrated, higher and lower pressure columns 12 and 14 are filled with mass transfer elements which can be trays, or packing such as structured packing or random packing.

In the higher pressure column 12, the air is distilled to form a nitrogen-rich tower overhead and an oxygen-rich column bottoms. The air is further refined in lower pressure column 14 to produce a liquid oxygen column bottoms within a bottom region 16 thereof. A product stream 82 (to be discussed hereinafter) composed of the liquid oxygen column bottoms is extracted and then totally warmed with main heat exchanger 10.

It is to be noted that as used herein and in the claims, the term "fully warmed" means warmed to a temperature at which the compressed and purified air enters in heat exchanger 10. The term "fully cooled" means cooled to a temperature which the cryogenic rectification is conducted which is normally at the temperature of the cold end of main heat exchanger 10. The terms "partly cooled" or "partly warmed" mean warmed to a temperature between that of fully warmed and fully cooled.

More specifically, the air after having filtered in filter 18 is compressed in a compressor 20 having stages 22 and 24. The compressed air is then purified within the prepurification unit 26 which may be beds of alumina operating out of phase to remove moisture and carbon dioxide. The resultant compressed and purified air is divided into the first and second subsidiary streams 28 and 30. First subsidiary stream 28 is further compressed in a compressor 32 having stages 34 and 36 to form a further compressed stream 38. Second subsidiary 30 after having been partially cooled is divided into two parts. A first of the two parts 40 is expanded within a turboexpander 42 with performance of work to form a refrigerant stream 44. After refrigerant stream 44 is fully cooled, it is then introduced lower pressure column 14. The second of the two parts, designated by reference numeral 46, is fully cooled and then introduced higher pressure column 12. Further compressed stream 38 is valve expanded within a valve 48 and introduced into higher pressure column 12. Depending upon the exact cycle, further compressed stream 38 may be sufficiently cooled in main heat exchanger 10 so as to form liquid air.

Lower pressure column 14 is provided with a lower reboiler 50 located within bottom region 16 of lower pressure column 14. A cold compressor 52 is interposed between lower reboiler 50 and higher pressure column 16 to compress a first nitrogen stream 54 composed of the nitrogen-rich tower overhead. The liquid oxygen column bottoms vaporizes and thereby condenses within lower reboiler 50 to form a nitrogen liquid stream 56 which is then valve expanded to operational pressure of higher pressure column 12 by an expansion valve 58. An intermediate reboiler 60 is associated with intermediate location of lower pressure column 14 to provide reboil in such section. Intermediate reboiler 60 is connected to higher pressure column 12 to condense a second nitrogen rich stream 62 composed of nitrogen-rich tower overhead. Second nitrogen rich stream 62 condenses therein to form an additional nitrogen liquid steam 64. Nitrogen liquid steam 56 and additional nitrogen liquid stream 64 are used to provide liquid nitrogen to reflux higher and lower pressure columns 12 and 14. As illustrated, this is effectuated by introducing a reflux stream 66 into higher pressure column 12 and another reflux stream 68 into lower pressure column 14 in order to effectuate the foregoing introduction. Reflux stream 68 is valve expanded in an expansion valve 70 to the operational pressure of lower pressure column 14.

A crude liquid stream 72, composed of the oxygen rich liquid column bottoms of higher pressure column 12, is valve expanded within expansion valve 74 to the operational pressure of lower pressure column 14. The crude liquid stream 72 is passed into intermediate reboiler 60 and partially vaporized against the condensation of nitrogen. The resulting vapor stream is introduced into lower pressure column 14 to further refine the air.

It should be noted that intermediate reboiler 60 is illustrated as lying outside of lower pressure column 14. As would be known to those skilled in the art, an intermediate reboiler having the same function as intermediate reboiler 60 could be positioned within lower pressure column 14 at the same level of introduction of crude liquid stream 72 after its partial vaporization. A further point is that a reboiler having the function of lower reboiler 50 could similarly be positioned outside of lower pressure column 14. Such reboiler would have to be provided with passes to boil liquid oxygen. In any event, the term "intermediate location" is meant to designate a location between the top and bottom of lower pressure column 14. Its exact location simply be a matter of design with a view towards optimization of the performance of lower pressure column 14 by bringing the operating line of the distillation being conducted closer to the vapor-liquid equilibrium line as would be graphically illustrated in a McCabe-Theile Diagram. In the illustrated embodiment, intermediate location was selected to be a level of the column in which the liquid concentration is equal to that of the oxygen-enriched liquid columns bottoms of higher pressure column 12.

Further compressed air stream 38, after having been liquefied, is valve expanded within expansion valve 48. This produces two phase flow mixture of liquid and vapor. The liquid component of this mixture preferably extracted as a liquid air stream 78 that is expanded in an expansion valve 79 to the operational pressure of lower pressure column 14. Thereafter, liquid air stream 78 is introduced into lower pressure column 14 for further refinement. Thus, higher pressure column 12 is acting as a phase separator which, although less preferably, similarly could be provided by an external pot.

The waste nitrogen stream 76 is then fully warmed within main heat exchanger 10 and is discharged as waste nitrogen, labeled "WN". As illustrated, liquid nitrogen contained within reflux stream 68, crude liquid stream 72, and liquid air stream 78 are subcooled within a subcooling unit 80 which is preferably provided to subcool the foregoing streams before their introduction into lower pressure column 14. Subcooling is produced through indirect heat exchange with waste nitrogen 76.

Product stream 82 is extracted from bottom region 16 of lower pressure column 14 and then is vaporized within main heat exchanger 10 to produce the oxygen product as a vapor. As would be known to those skilled in the art, product stream 82 could be pressurized by being pumped before being vaporized. It is intended by the inventors herein that such pumping not be excluded from the coverage of the claims appended hereto.

In the illustrated embodiment, higher pressure column 12 designed to operate with air compressor 20 producing a compressed and purified air stream at a pressure approximately 3.4 bar (a). Cold compressor 52 designed to boost pressure to 5.2 bar (a). The pressure of lower pressure column 14 is 1.3 bar (a) and the flow to reboilers 50 and 60 is in the ratio of approximately 0.45.

While the present invention has been described with reference to preferred embodiment, as will occur to those skilled in the art, numerous changes, additions and omissions may be made without departing from the spirit and scope of the present invention.

We claim:

1. A method of separating air to produce an oxygen product, said method comprising:

cooling compressed and purified air to a temperature suitable for its rectification and introducing said air into a double column rectification system having a higher pressure column and a lower pressure column;

rectifying said compressed and purified air within said double column rectification system so that a nitrogen-rich tower overhead and an oxygen-rich liquid column bottoms are produced within said higher pressure column and an oxygen liquid column bottoms is produced within said lower pressure column;

reboiling said lower pressure column by cold compressing a first nitrogen stream composed of said nitrogen-rich tower overhead and introducing said first nitrogen stream into a reboiler associated with a bottom region of said lower pressure column, thereby to form a nitrogen liquid stream;

reboiling said lower pressure column at an intermediate location thereof with a second nitrogen rich stream composed of said nitrogen-rich tower overhead, thereby to form an additional nitrogen liquid stream;

refluxing said lower and higher pressure columns with liquid nitrogen contained within said nitrogen liquid stream and said additional nitrogen liquid stream; and extracting a product stream composed of said oxygen liquid column bottoms and fully warming said stream through indirect heat exchange with said compressed and purified air, thereby to form said oxygen product.

2. The method of claim 1, wherein:

said compressed and purified air is divided into first and second subsidiary streams;

said first subsidiary stream is further compressed to form a further compressed stream;

said second stream after having been partially cooled is divided into two parts;

a first of said two parts is expanded with performance of work to form a refrigerant stream;

said refrigerant stream is introduced into said lower pressure column;

second of said two parts is fully cooled and introduced into said higher pressure column;

said first subsidiary stream is liquefied, valve expanded to higher pressure column pressure, and is introduced into said higher pressure column; and a liquid air stream is removed from the higher pressure column, valve expanded and introduced into the lower pressure column.

3. The method of claim 2, wherein said rich liquid stream, said liquid air stream, a stream of said nitrogen liquid used in refluxing said lower pressure column are subcooled prior to their being introduced into said lower pressure column.

4. The method of claim 1, wherein said higher pressure column pressure is about 3.4 bar (a) and said first nitrogen stream is compressed to about 5.2 bar (a).

5. An apparatus for separating air to produce an oxygen product, said apparatus comprising:

a main heat exchanger for cooling compressed and purified air to a temperature suitable for its rectification a double rectification column system having a higher and lower pressure column configured to rectify said air so that a nitrogen-rich tower overhead and an oxygen-rich liquid column bottoms are produced within said higher pressure column and an oxygen liquid column bottoms is produced within said lower pressure column;

said main heat exchanger connected to said double rectification column system so that said compressed and purified air is introduced therein;

a lower reboiler associated with a bottom region of said lower pressure column;

a cold compressor interposed between said lower reboiler and said higher pressure column to compress a first nitrogen stream composed of said nitrogen-rich tower overhead and introduce said first nitrogen stream into said lower reboiler to form a nitrogen liquid stream;

an intermediate reboiler associated with an intermediate region of said lower pressure column and connected to said higher pressure column so that a second nitrogen rich stream composed of said nitrogen-rich tower overhead condenses therein and forms an additional nitrogen liquid stream;

said lower and intermediate reboilers, and said higher and lower pressure columns associated with one another so that liquid nitrogen contained within said nitrogen liquid stream and said additional nitrogen liquid stream reflux said higher and said lower pressure columns; and said lower pressure column connected to said main heat exchanger so that a product stream composed of said oxygen liquid column bottoms is fully warmed through indirect heat exchange with said cooled and compressed air, thereby to form said oxygen product.

6. The apparatus of claim 5, wherein:

a booster compressor is connected to said main heat exchanger so that said compressed and purified air is divided into first and second subsidiary streams;

said first subsidiary stream is further compressed by said booster compressor to form a further compressed stream;

said main heat exchanger is configured so that said second stream after having been partially warmed is divided into two parts, a first of said two parts is discharged from said main heat exchanger and a second of said two parts is fully cooled, said further compressed stream is liquefied upon being fully cooled, and said product stream is fully warmed to produce said oxygen product as a vapor;

a turbo-expander is interposed between said main heat exchanger and said lower pressure column to expand said first of said two parts of said second stream, thereby to form a refrigerant stream that is introduced into said lower pressure column;

said main heat exchanger is connected to said higher pressure column so that said second of two parts of said second subsidiary stream and said further compressed stream are introduced into said higher pressure column;

an expansion valve to valve expand said further compressed stream to higher pressure column pressure;

said higher and lower pressure columns associated with one another so that a liquid air stream flows from the higher pressure column to the lower pressure column; and a further expansion valve to valve expand said liquid air stream from the higher pressure column pressure to a lower pressure column pressure.

7. The apparatus of claim 6, further comprising a subcooling unit configured to subcool said rich liquid stream, said liquid air stream, a stream of said nitrogen liquid used in refluxing said lower pressure column prior to their being introduced into said lower pressure column.

* * * * *